United States Patent [19]

Mitani

[11] Patent Number: 4,462,581

[45] Date of Patent: Jul. 31, 1984

[54] VISE WITH CHANGEABLE GRIPPING ELEMENTS

[76] Inventor: Shigeto Mitani, 3921 W. 231st St., Torrance, Calif. 90505

[21] Appl. No.: 401,074

[22] Filed: Jul. 23, 1982

[51] Int. Cl.[3] ..... B25B 1/24

[52] U.S. Cl. ..... 269/283

[58] Field of Search ..... 269/279–284; 24/68 T; 81/180 B, 57.15, 57.2, 57.33

[56] References Cited

U.S. PATENT DOCUMENTS

| | | | |
|---|---|---|---|
| 530,733 | 12/1894 | Tower . | |
| 890,063 | 6/1908 | Jones | 269/279 |
| 1,163,145 | 12/1915 | Gross . | |
| 1,478,668 | 12/1923 | McCloud et al. | 81/180 B |
| 1,488,559 | 4/1924 | Simokaitis . | |
| 2,770,156 | 11/1956 | Brettrager . | |
| 3,768,797 | 10/1973 | Kartasuk et al. . | |
| 4,251,066 | 2/1981 | Bowling . | |

FOREIGN PATENT DOCUMENTS

| | | | |
|---|---|---|---|
| 422944 | 12/1925 | Fed. Rep. of Germany | 269/281 |
| 1237780 | 6/1960 | France | 269/282 |
| 2457151 | 1/1981 | France | 269/283 |
| 75808 | 10/1949 | Norway | 24/68 T |
| 1240759 | 7/1971 | United Kingdom | 269/281 |

*Primary Examiner*—Robert C. Watson

*Attorney, Agent, or Firm*—William P. Green

[57] ABSTRACT

A vise including two jaws at least one of which has a gripping element with a plurality of different gripping faces, with that gripping element being adapted to be turned to different positions in which different ones of those faces are engageable in gripping relation with a workpiece. The gripping element is desirably square in cross-section to present four different work contacting faces, and preferably is retained by connections at opposite ends of the gripping element including clamps for releasably holding the gripping element in active condition.

10 Claims, 3 Drawing Figures

FIG. 1
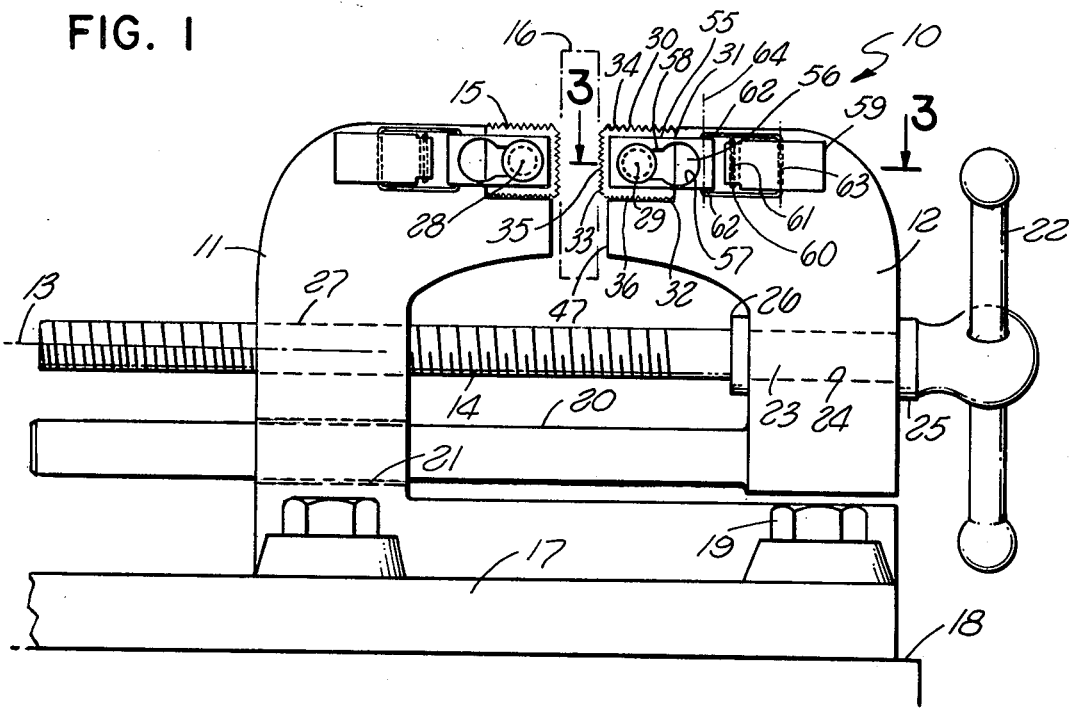
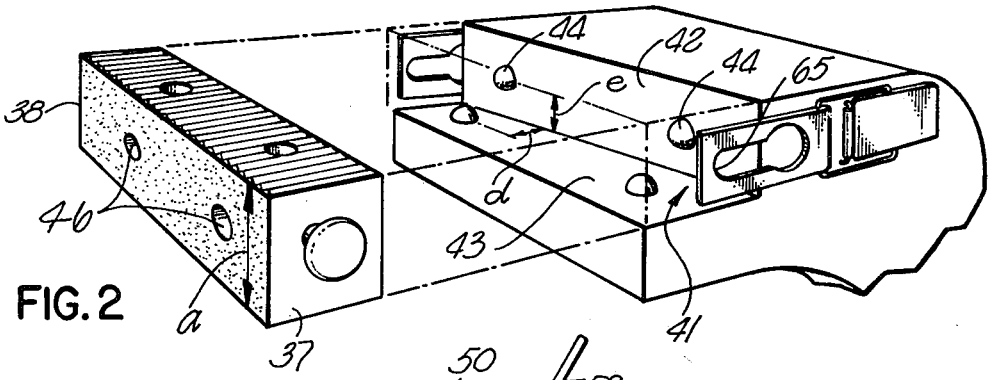
FIG. 2
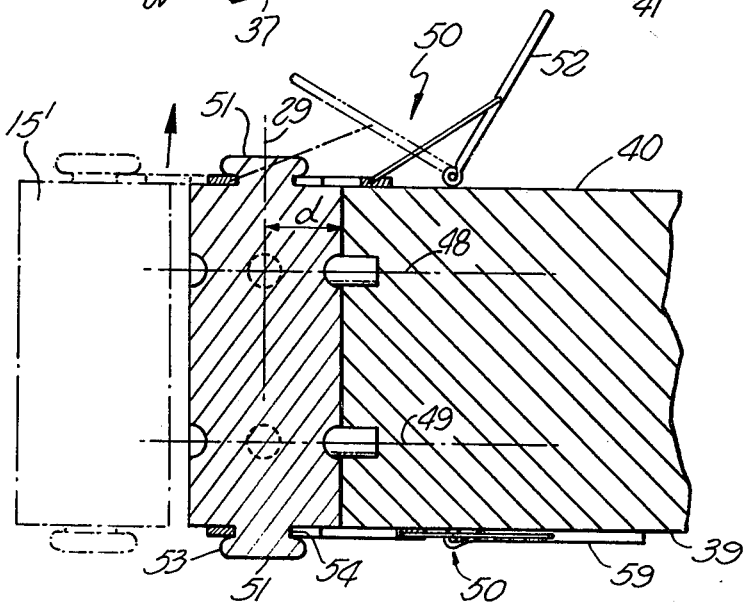
FIG. 3

VISE WITH CHANGEABLE GRIPPING ELEMENTS

BACKGROUND OF THE INVENTION

This invention relates to improved vise structures.

Most conventional vises are limited by the configuration of the work gripping faces of their jaws as to the types of workpieces which can be held effectively by the vise. A vise for gripping wood or other soft material should usually have jaws with smooth gripping surfaces, but this type of jaw can not satisfactorily grip most metal parts. Further, some types of workpieces require jaws with very fine gripping teeth, whereas other workpieces may be held best by a surface having coarse teeth.

SUMMARY OF THE INVENTION

The purpose of the present invention is to provide an improved vise which can be easily and quickly converted between different conditions for gripping different types of workpieces. In those different conditions, the jaws of the vise present surfaces having different gripping characteristics to the workpiece, enabling workpieces of different types to be held effectively and rigidly in place in optimum manner. Further, the overall vise structure may be so constructed as to include exactly the same parts in all of the different conditions of the device.

To achieve these results, at least one of the gripping jaws of the vise and preferably both the jaws include a gripping element which is formed separately from the main body of the jaw and which has a plurality of different work contacting faces configured differently for engagement with different types of workpieces. For example, one of the faces may be essentially smooth for gripping wooden parts, while others of the faces may have gripping teeth of different types. The gripping element is adapted to be turned relative to the jaw by which it is carried to positions in which the different faces respectively of the element face toward and grip the workpiece. Preferably, the gripping element is of essentially square cross-section, and has four different gripping faces at its different sides. The gripping element may then be turned to any of four different settings, so that any desired one of the gripping faces can be directed toward the workpiece. In all of these settings, the gripping element may be received at the same location relative to the jaw by which it is carried.

The gripping element is desirably secured to the jaw body by connections at opposite ends of the gripping element, at least one of which, preferably both, includes a clamp actuable between an active holding condition and a released condition in which the gripping element is freed to turn between its different positions. The clamp or clamps may be constructed to effectively hold the gripping element in an active position relative to the jaw body regardless of the rotary position to which the gripping element is turned, and thus regardless of which of the several different gripping faces of the element is exposed for contact with a workpiece.

BRIEF DESCRIPTION OF THE DRAWING

The above and other features and objects of the invention will be better understood from the following detailed description of the typical embodiment illustrated in the accompanying drawing in which:

FIG. 1 is a side view of a vise constructed in accordance with the invention;

FIG. 2 is an exploded perspective view of one of the jaws of the device and the gripping element carried thereby; and FIG. 3 is a fragmentary horizontal section taken on line 3—3 of FIG. 1.

DESCRIPTION OF THE PREFERRED EMBODIMENT

A vise embodying the invention is illustrated at 10 in FIG. 1, and includes two jaws 11 and 12 which are actuable toward and away from one another along an axis 13 by an adjusting screw 14. The jaws carry two preferably identical gripping elements 15 for engaging and gripping a workpiece represented diagrammatically at 16.

The jaws may be mounted in any convenient manner for their relative movement toward and away from one another, as by forming jaw 11 to have a base portion 17 attachable to a workbench or other support 28 by bolts 19, and providing the second jaw 12 with a projection 20 extending parallel to axis 13 of the adjusting screw and slidably received and confined within a passageway 21 in jaw 11 to effectively guide jaw 12 for movement parallel to axis 13 relative to jaw 11. Screw 14 may be manually rotatable by a handle 22, and have an unthreaded portion 23 rotatably received within a passage 24 in the body of jaw 12 and retained against axial movement relative thereto by shoulders and 26 extending radially outwardly from and fixed with respect to the screw. The screw threadedly engages jaw 11 at 27 to effect the desired movement of the jaws toward and away from one another in response to manual rotation of the screw.

The two gripping elements 15 may be elongated in the direction of two parallel horizontal axes 28 and 29. As seen in FIG. 1, each of the gripping elements is desirably of square cross-section transversely of its axis 28 or 29, and as a result has four essentially rectangular sides 30, 31, 32 and 33 projecting in four different directions offset ninety degrees from one another. These surfaces, which function as gripping faces for contacting the workpiece 16, are configured differently to have different gripping characteristics for contacting workpieces of different types. For example, the surface identified by the number 31 in FIG. 1 may be a completely smooth planar surface having substantially no gripping teeth or irregularities of any type and capable of contacting and holding a workpiece of wood or other soft material without damaging it. The other three surfaces 30, 32 and 33 may have gripping teeth of different types. In FIG. 1, the surface 30 is represented as having teeth 34 which are relatively large and coarse. The teeth 35 of surface 33 are smaller and finer, while the teeth 36 of surface 32 are still finer. In each instance, the teeth of a particular surface lie generally in a common plane.

The discussed square cross-sectional configuration of each of the gripping elements 15 is essentially uniform along the length of the gripping element between two opposite end surfaces 37 and 38 which may be disposed directly transversely of axis 28 or 29 of the corresponding gripping element and which in the installed position of the gripping element are essentially aligned with flat opposite end surfaces 39 and 40 of the corresponding jaw body 12 by which that particular gripping element is held.

For locating the gripping elements with respect to jaws 11 and 12, each of the jaws contains a recess 41 dimensioned to receive the corresponding gripping element with the latter projecting slightly therefrom both horizontally and vertically. This recess 41 is designed by a vertically extending wall 42 forming the back of the recess and a horizontal wall 43 facing upwardly for engagement with the bottom of one of the gripping elements. These two mutually perpendicular surfaces 42 and 43 are planar except for the provision of two horizontally spaced lugs or projections 44 extending outwardly from and beyond vertical surface 42, and two spaced lugs or projections 45 formed by and projecting upwardly above bottom surface 43. These lugs 44 and 45 are positioned for reception within coacting locating recesses 46, two of which are formed in each of the gripping surfaces 30, 31, 32 and 33 of each gripping element. The spacing between the two projections 44 is the same as the spacing between the two projections 45, and is also the same as the spacing between the two recesses 46 formed in each of the gripping faces 30, 31, 32 and 33. Also, these projections and recesses are so located that when the projections 44 are received within one of the pairs of recesses 46 in the gripping element the projections 45 are in the same position of the gripping element received within another of the pairs of recesses 46 in the same gripping element. For example, in the FIG. 1 position of the gripping elements, the vertical surface 42 of jaw 12 is in abutting engagement with vertical back surface 31 of the corresponding gripping element, and the projections 44 are received within the two recesses 46 in that surface 31. In the same position, the upwardly facing support surface 43 of jaw 12 is in abutting and supporting engagement with the undersurface 32 of the gripping element, and the two projections 45 on surface 43 extend upwardly into the recesses 46 in surface 32 of the gripping element. In this condition, the gripping face 33 is the active one and projects to a position leftwardly beyond surface 47 of jaw 12 to enable surface 33 to contact a workpiece without direct contact of the workpiece with the jaw surface 47.

If the gripping element 15 in jaw 12 is turned through ninety degrees about its longitudinal axis 29 in either a clockwise or counterclockwise direction from the position of FIG. 1, this will bring either surface 30 or surface 32 into the vertically extending exposed position for contact with a workpiece, and lugs 44 and 45 will still be received within two pairs of the recesses 46 in two mutually perpendicular surfaces of the gripping element. In this way, the gripping element can be turned to any of four different positions to expose any of its four faces 30, 31, 32 or 33 to the workpiece, and in each of these positions the lugs 44 and 45 are received within two pairs of the recesses 46 in the gripping element and act to effectively locate the gripping element against movement from its proper position of reception within recess 41 in the jaw.

To attain these results, it is noted that the two projections 44 on surface 42 preferably lie in two spaced parallel vertical planes 48 and 49 (FIG. 3), and similarly the two projections 45 lie in these two planes respectively, with the two recesses 46 of each of the gripping faces of element 15 also lying in planes 48 and 49 respectively. Additionally, each of the recesses 46 is located at the midpoint of the width dimension a of the corresponding gripping face of element 15 (FIG. 2). To properly engage these recesses, the lugs 45 on surface 43 are spaced a distance d from the plane of surface 42, which distance d equals one-half of the dimension a of FIG. 2, and similarly the dimension E between each lug 44 and surface 43 is equal to dimensions d and one-half of the dimension a.

For releasably retaining gripping elements 15 within recesses 41 in the jaws, two connections or connecting assemblies 50 are provided for securing opposite ends of each gripping element in fixed position relative to the corresponding jaws. These connections include projections 51 extending axially from opposite ends of the gripping element and the adapted to coact with two preferably identical clamps 52 carried by the corresponding jaw 11 or 12. Each projection 51 may have an enlarged diameter circular head 53 and a reduced diameter cylindrical shank 54 with which the coacting clamp is engageable.

Each clamp 52 includes a part 55 which may be a flat planar rectangular piece of sheet metal, containing a keyhole slot 56 having a circular end portion 57 of a diameter to receive and pass therethrough the enlarged head 53 of one of the projections 51 on the gripping element. Extending horizontally from this enlarged portion 57, each slot 56 has a portion 58 of reduced vertical width corresponding to the diameter of shank 54 of projection 51 but narrower than the enlarged diameter head 51 of the projection. A handle lever 59 of clamp 52 is mounted by a hinge pin 60 for pivotal movement about a vertical axis 61 relative to the corresponding jaw 11 or 12 and is adapted to swing between a position adjacent one of the end faces 39 or 40 of the jaw (see lower clamp of FIG. 3) and a position such as that represented in broken lines at the top of FIG. 3. This swinging movement of handle lever 59 causes leftward and rightward movement of part 55 as viewed in FIG. 3 by virtue of interconnection of these parts by two similar links 62, whose first ends are connected to lever 59 for relative pivotal movement about an axis 63, and whose second ends are connected to part 55 for relative pivotal movement about an axis 64.

To describe now the manner of use of the illustrated vise structure, assume that gripping elements 50 are initially attached to jaws 11 and 12 in the relationship illustrated in FIG. 1. In that condition, the handle levers 59 of clamps 52 are in a position corresponding to the clamp illustrated in the lower portion of FIG. 3, that is, with the two handle levers received closely adjacent surfaces 39 and 40 respectively of the corresponding jaw 11 or 12. In this condition, the shank portion 54 of each of the projections at opposite ends of each gripping element 15 are received within the narrow portion 58 of slots 57 of parts 55, with the shanks engaging the left ends 65 of the slots in a relation causing the clamps and their parts 55 to exert a force pulling each gripping element tightly into the corresponding recess 41 in jaw 11 or 12. For example, as seen in FIG. 1, the clamps associated with jaw 12 act to pull surface 31 of the right-hand gripping element 15 tightly against the back surface 42 of recess 41, to thereby retain the gripping element tightly in fixed position in the excess. The other gripping element is similarly held tightly to and in fixed position relative to jaw 11. In this condition, the handle lever 59 of each clamp is swung to a slightly overcenter position preventing accidental release of the clamp. More particularly, the axis 63 of each clamp is swung slightly beyond a position of alignment with a plane containing the two pivotal axes 61 and 64.

In the described condition of the parts, the surfaces 35 of the gripping elements are exposed for contact with a workpiece. If a workpiece of a different material or type is to be gripped, the clamps 52 may be released to permit rotation of the gripping elements through ninety degrees or one-hundred and eighty degrees to expose any of the other three gripping faces for contact with the workpiece. The clamping elements are released for this purpose by swinging their handle levers 59 from a position corresponding to the clamp represented in the lower portion of FIG. 3 through the full line position of the upper clamp of that figure and to the broken line position of that upper clamp. In that broken line position, the two connected elements 55 of each clamp are moved outwardly away from a corresponding jaw (leftwardly in FIG. 3) enabling the gripping element 15 to be correspondingly moved leftwardly, as to the broken line position 15' in FIG. 3, in which position the gripping element may be entirely leftwardly beyond the vertical plane of surface 47 of jaw 12 to enable element 15 to be turned about its axis 29 as discussed to the desired new position. Alternatively, the gripping element may be designed to allow leftward movement of the gripping element through a distance which is shorter and may not locate the gripping element entirely to the left of the planar surface 47, but with sufficient looseness being provided in the pivotal connections of the clamps to enable gripping element 15 to be shifted slightly upwardly, just far enough to allow it to be rotated while still partially within recess 41. After the gripping element has been turned to the proper position, the clamps are actuated to pull it back into recess 41 and retain it tightly in position in its new orientation with respect to the corresponding jaw. If it is desired to remove the gripping element completely from the jaw, this may be effected by swinging the handle levers 52 of the two retaining clamps to a position such as that represented in full lines in the upper portion of FIG. 3, in which position the circular and enlarged portions 57 of slots 56 are received axially opposite the enlarged diameter heads 53 of projections 51, enabling the parts 55 to be moved axially away from the end surfaces 37 and 38 of the gripping element and past the enlarged heads 53 in a manner freeing the gripping elements from the jaws.

While a certain specific embodiment of the present invention has been disclosed as typical, the invention is of course not limited to this particular form, but rather is applicable broadly to all such variations as fall within the scope of the appended claims.

I claim:

1. A vise comprising:

two jaws;

means for actuating said jaws relatively toward and away from one another to grip a workpiece;

a gripping element carried by one of said jaws for contacting and gripping said workpiece;

said gripping element having a plurality of different work contacting faces configured differently for engagement with different types of workpieces, and being adapted to be turned relative to said one jaw to positions in which said different faces respectively face toward and grip the workpiece; and two connections at opposite ends of said gripping element for attaching it to said one jaw;

one of said connections comprising a clamp at one of said ends of the gripping element actuable between an active condition in which it holds said gripping element in one of said positions thereof and a released condition in which said gripping element is free to turn between said different positions of the gripping element;

said clamp when in said active condition thereof being constructed to secure said gripping element to said one jaw in any of said different positions of the gripping element in which said different faces respectively are exposed for gripping contact with the workpiece;

said gripping element having a projection at said one end thereof with an enlarged head at its extremity and a reduced diameter shank axially inwardly of the head;

said clamp including a part having a slot within which said shank of said projection is received, with said slot having a reduced width portion narrower than said head within which the shank is received in said active condition of the clamp and an enlarged portion adapted to pass said head therethrough in said released condition of the clamp for detachment of said element from the clamp.

2. A vise as recited in claim 1, in which said clamp includes an actuating are connected to said one jaw for swinging movement relative thereto, and a link between said arm and said part acting upon swinging movement of the arm to pull said part in a relation moving said gripping element toward said one jaw.

3. A vise as recited in claim 1, including two of said releasable clamps at opposite ends of said gripping element forming said connections respectively.

4. A vise as recited in claim 1, in which said projection is constructed to rotate relative to said clamp in said released condition of the clamp to enable said turning movement of the gripping element between said positions thereof.

5. A vise as recited in claim 1, in which said one jaw has projection means for engaging and locating said gripping element, and said gripping element has recesses in said faces thereof for receiving said projection means in said different positions of the gripping element in locating relation.

6. A vise as recited in claim 1, in which said one jaw has an essentially vertical surface engageable with a back side of said gripping element and as an upwardly facing surface engageable with the underside of the gripping element, said essentially vertical surface and said upwardly facing surface having locating projections extending therefrom, and said different faces of the gripping element containing recesses within which said projections are received in locating relation in said different positions to which said gripping element can be turned.

7. A vise as recited in claim 1, in which said gripping element is of essentially square cross-section and has four of said different gripping faces selectively engageable with a workpiece in four different positions of the gripping element relative to said one jaw.

8. A vise as recited in claim 1, in which there are two of said gripping elements carried by said two jaws respectively and each retained at its opposite ends by two of said connections including two of said clamps respectively, each of said gripping elements being of essentially square cross-section and having four of said gripping faces selectively engageable with a workpiece in four different positions to which the gripping element can be turned, each gripping element having two projections extending from its opposite ends and engageable with two of said clamps respectively.

9. A vise as recited in claim 8, in which each of said jaws has an essentially vertical surface for engaging a back side of one of the gripping elements with lugs projecting therefrom, and each jaw has an upwardly facing surface for engaging the underside of a gripping element with lugs extending upwardly therefrom, each of said faces of the gripping element containing recesses for receiving said lugs in locating relation.

10. A vise comprising:

two jaws;

means for actuating said jaws relatively toward and away from one another to grip a workpiece;

two gripping elements carried by said jaws respectively for contacting and gripping said workpiece;

each of said gripping elements being of essentially square cross section and having four different work contacting faces configured differently for engagement with different types of workpieces, and being adapted to be turned relative to said the corresponding jaw to four different positions in which said different faces respectively face toward and grip the workpiece; and two connections at opposite ends of each of said gripping elements for attaching it to the corresponding jaw;

each of said connections comprising a clamp at one of said ends of the corresponding gripping element actuable between an active condition in which it holds said gripping element in one of said positions thereof and a released condition in which said gripping element is free to turn between said different positions of the gripping element;

each of said clamps when in said active condition thereof being constructed to secure the corresponding gripping element to one of said jaws in any of said different positions of the gripping element in which said different faces respectively are exposed for gripping contact with the workpiece;

each of said jaws having an essentially vertical surface for engaging a back side of one of the gripping elements with lugs projecting therefrom, and each jaw having an upwardly facing surface for engaging the underside of a gripping element with lugs extending upwardly therefrom;

each of said faces of each gripping element containing recesses for receiving said lugs in locating relation;

each of said gripping elements having two projections at its opposite ends engageable with two of said clamps respectively and having enlarged heads and reduced diameter shanks inwardly thereof;

each clamp including a part containing a slot receiving a corresponding one of said projections and having a narrow portion receiving said shank of the projection in said active condition of the clamp and an enlarged portion adapted to pass the head of the corresponding projection in a released condition of the clamp;

each clamp including a swinging arm connected pivotally to a corresponding one of said jaws, and a link attaching said swinging arm to said part to actuate it between an active gripping element holding condition and released condition.

* * * * *